US010946222B2

(12) United States Patent
Hansen et al.

(10) Patent No.: US 10,946,222 B2
(45) Date of Patent: Mar. 16, 2021

(54) BREACHING ASSIST TOOL

(71) Applicant: KBT, LLC, Bellevue, WA (US)

(72) Inventors: Douglas C. Hansen, Bellevue, WA (US); Paul Joseph Shemeta, Seattle, WA (US)

(73) Assignee: KBT, LLC, Bellevue, WA (US)

( * ) Notice: Subject to any disclaimer, the term of this patent is extended or adjusted under 35 U.S.C. 154(b) by 218 days.

(21) Appl. No.: 15/654,589

(22) Filed: Jul. 19, 2017

(65) Prior Publication Data

US 2018/0021604 A1 Jan. 25, 2018

Related U.S. Application Data

(60) Provisional application No. 62/364,031, filed on Jul. 19, 2016.

(51) Int. Cl.

| | |
|---|---|
| ***A62B 3/00*** | (2006.01) |
| ***B25D 9/11*** | (2006.01) |
| ***B25D 17/24*** | (2006.01) |

(52) U.S. Cl.

CPC ..... *A62B 3/005* (2013.01); *B25D 9/11* (2013.01); *B25D 17/24* (2013.01)

(58) Field of Classification Search

CPC ..... B25D 9/11; B25D 17/24; A62B 3/005

USPC ..... 173/90, 91, 210, 211, 212; 227/8, 9, 10, 227/11

See application file for complete search history.

(56) References Cited

U.S. PATENT DOCUMENTS

| | | | | |
|---|---|---|---|---|
| 2,848,915 | A * | 8/1958 | Aitken | H01R 3/0422 72/1 |
| 4,631,779 | A * | 12/1986 | Castiello | A22B 3/02 42/1.12 |
| 4,686,786 | A * | 8/1987 | Termet | A22B 3/02 227/9 |
| 5,237,613 | A * | 8/1993 | Berry | B25C 1/188 29/254 |
| 5,415,241 | A * | 5/1995 | Ruffu | B25D 9/11 173/212 |
| 6,318,228 | B1 * | 11/2001 | Thompson | A62B 3/005 173/90 |
| 6,564,688 | B2 * | 5/2003 | Sabates | A22B 3/02 173/212 |
| 6,889,591 | B2 * | 5/2005 | Sabates | A22B 3/02 173/90 |
| 7,814,822 | B2 * | 10/2010 | Brennan | B25D 9/06 89/1.14 |
| 8,418,592 | B1 * | 4/2013 | Gonstad | B25D 17/02 89/1.14 |

* cited by examiner

*Primary Examiner* — Nathaniel C Chukwurah
(74) *Attorney, Agent, or Firm* — Christensen O'connor Johnson Kindness PLLC

(57) ABSTRACT

A kinetic breaching assist tool includes a ram slidably positioned within a ram housing to be extendable forwardly out of the housing for breaching doors and other barriers. The ram housing is connected to an intermediate propulsion section that generates high pressure gas to drive the ram forwardly. The rear end of the propulsion section is connected to a firing mechanism assembly, which is actuated by an elongated trigger positioned within the confines of a manually graspable rear handle assembly. A forward handle assembly is mounted at the forward portion of the propulsion section to enable to tool to be conveniently and securely grasped by both hands.

19 Claims, 10 Drawing Sheets

BREACHING ASSIST TOOL

CROSS-REFERENCE TO RELATED APPLICATION

This application claims the benefit of Provisional Patent Application No. 62/364,031, filed Jul. 19, 2016, the specification of which is hereby incorporated in its entirety.

BACKGROUND

The present disclosure relates to a breaching assist tool to provide rapid, forcible entry into buildings and structures with doors and other types of closures. Breaching assist tools are needed by law enforcement officials and the military to gain forcible entry when the closures thereto are locked or otherwise resistant to entry. Firemen also require the use of breaching assist tools to quickly open closures during a fire or other emergency.

One common form of breaching assist tool is a manually-operated battering ram, typically a pipe or similar object filled with concrete or other substances to increase the mass of the battering ram. Such battering rams typically require one or two persons to hold the ram by handles and swing the ram against the locked closure. Such battering rams have many disadvantages, including that the effectiveness of the ram is dependent on the strength of the users and such rams are only effective on inward opening doors. Different types of breaching tools and/or pry bars are required for outward opening doors and other barriers. In this regard, a manually-actuated battering ram is typically very heavy and bulky, making it difficult to transport and operate and additional breaching tools may be required depending on the obstacle faced by the breacher. Further, once the ram penetrates and breaks through a closure, there is no system to stop or slow the ram from continuing onwardly, and perhaps causing considerable unintended injury to the breaching operator or damage to the structure or its contents. Also, often several attempts may be needed to break through a door or other type of closure, allowing time for criminals or the enemy to escape or dispose of evidence.

In short, a breaching assist tool is needed for use by law enforcement, the military, firefighters, and others who need to safely and quickly breach a variety of barriers to entry. It is desirable that the breaching assist tool have high energy output which can be directed and controlled, thereby enabling a single operator to penetrate walls, doors, and shear locks with relative control and ease, thereby reducing the exposure of the operator to danger and minimizing any collateral damage to individuals, as well as to the structure in the vicinity of the breach. The present disclosure seeks to address the foregoing need for a breaching assist tool.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A breaching assist tool comprises a rectangularly shaped ram disposed within a ram housing, with an opening at the front of the housing through which the forward end of the ram is propelled during actuation of the tool. The tool also includes a propulsion system connected to the ram housing and composed of an elongated cylindrical barrel in which a piston is slidably positioned. A connecting rod interconnects the piston to the ram. The propulsion section also comprises an explosion chamber in communication with the back side of the piston. A firing mechanism is in communication with the explosion chamber to fire an explosive cartridge, with the gases generated by the explosion of the cartridge entering the explosion chamber and in turn propelling the piston, the connecting rod and ram forwardly to propel the ram out of the ram housing.

The breaching assist tool also includes a braking system for braking the forward travel of the piston, connecting rod and ram. The braking system includes an elongated snubber disposed within the propulsion section barrel to bear against the front side of the piston when the piston has traveled a sufficient distance forwardly within the barrel toward the ram housing. Also, a return actuator acts against the forward side of the piston to urge the piston back to its nominal rearward position within the barrel once the breaching assist tool has been actuated and the ram propelled out of the housing. The return actuator can be in the form of a compression spring or other device.

The ram housing has a nominal interior width closely corresponding to the width of the ram. A portion of the connecting rod is also disposed within the interior of the ram housing, with the connecting rod having a width larger than the width of the ram and thus, also the nominal width of the interior of the ram housing. To accommodate the wider width of the connecting rod, the ram housing has a localized width larger than the nominal width of the ram housing. Also, the portion of the ram in connection with the connecting rod has an increased width, which increased ram width is also accommodated by enlarging the corresponding width of the interior of the ram housing. The increased width of the ram housing is located in the rear portion of the ram housing so that the forward portion of the ram housing is of a narrower nominal width corresponding to the width of the ram. This structure of the ram housing serves as a safety brake, in that if the snubber fails to stop the forward travel of the ram, the increased width of the ram at its connection location with the connecting rod will wedge against the sides of the ram housing interior if the ram travels forwardly beyond the portion of the ram housing having an increased width. As such, the forward travel of the ram will be arrested.

In accordance with a further aspect of the present disclosure, the piston is of hollow construction, having a forward face toward the ram and a rearward face having a central, concave section, defining a forward portion of the explosion chamber. The rear portion of the explosion chamber is formed in a housing coupled to the rear end of the barrel. The housing has a concave shape corresponding to the shape of the rear side of the piston.

In accordance with a further aspect of the present disclosure, the firing mechanism assembly includes a housing having a forward portion mating with the rearward portion of the propulsion section. A cartridge chamber is positioned in the firing mechanism assembly in communication with the explosion chamber. The propulsion section includes a passageway extending between the explosion chamber and the cartridge chamber.

In accordance with a further aspect of the present disclosure, a sealing mechanism is provided to seal the explosion chamber passageway against the cartridge chamber when the cartridge is fired to prevent leakage of the explosion gas generated by the firing of the cartridge. In this regard, the sealing member includes a bellows assembly that expands in length upon the explosion of a cartridge in the cartridge chamber, with the bellows forming a seal between the explosion chamber passageway and the adjacent face of the cartridge chamber.

In accordance with a further aspect of the present disclosure, the firing mechanism assembly includes a firing pin for firing the cartridge disposed in a chamber of a cartridge magazine. The firing pin is nominally out of alignment with the cartridge chamber. The firing mechanism assembly includes a linkage system for supporting the firing pin and positioning the firing pin into alignment with the cartridge chamber to fire the cartridge located within the cartridge chamber.

In accordance with a further aspect of the present disclosure, the firing mechanism assembly includes a cylindrically shaped cartridge magazine mounted to revolve about a central axis, thereby to align cartridge chambers within the cartridge magazine with the explosion chamber, when firing a cartridge disposed within the cartridge chamber magazine.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
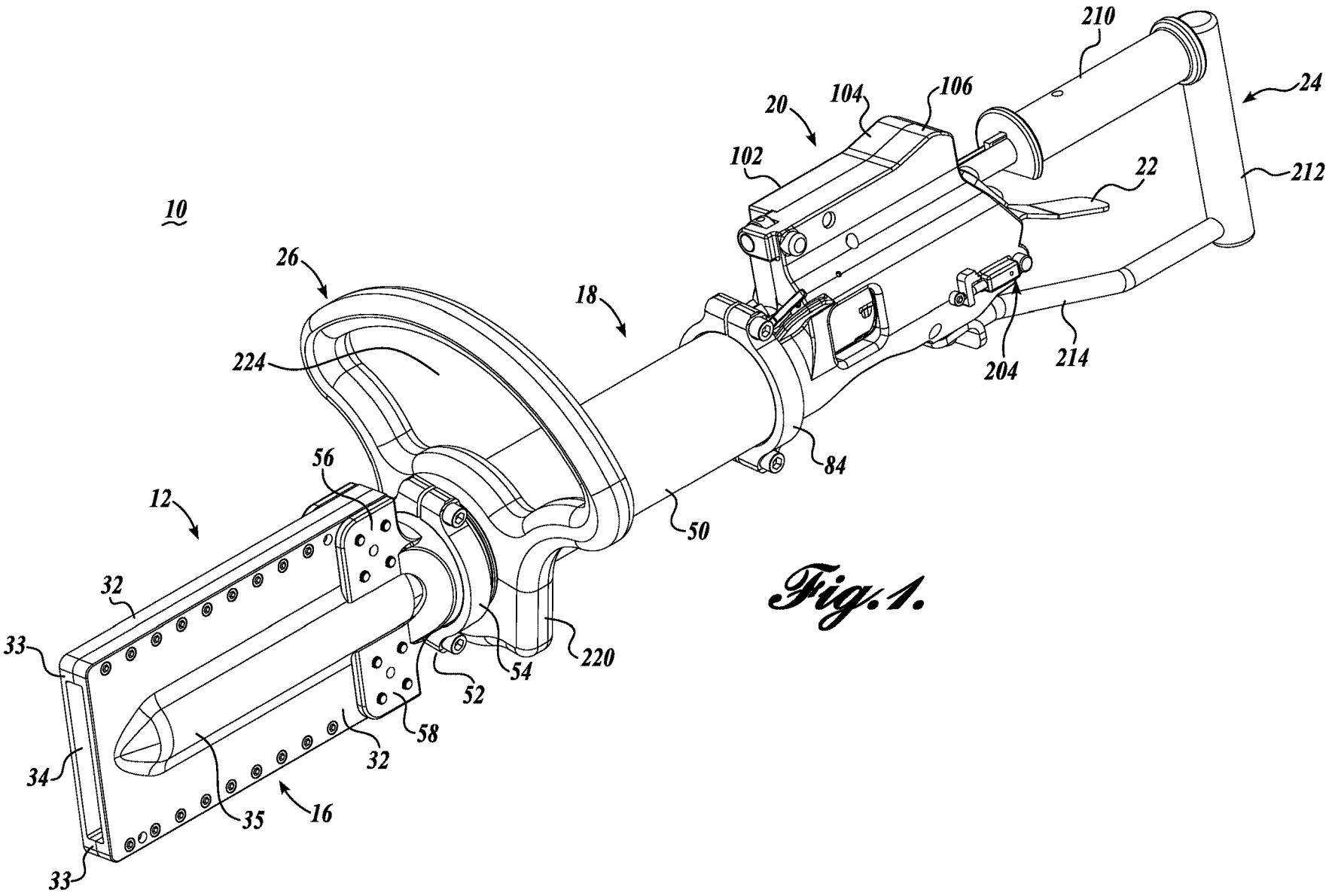
FIG. 1 is an isometric view of the breaching assist tool of the present disclosure taken from above and looking to the rear of the tool.

The description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to "directions," such as "forward," "rearward," "front," "back," "ahead," "behind," "upward," "downward," "above," "below," "top," "bottom," "in," "out," "extended," "advanced," "retracted," "proximal," "distal," etc. These references and other similar references in the present application are only to assist in helping describe and understand the present disclosure and are not intended to limit the present invention to these directions.

The present application may include modifiers such as the words "generally," "approximately," "about", or "substantially." These terms are meant to serve as modifiers to indicate that the "dimension," "shape," "temperature," "time," or other physical parameter in question need not be exact, but may vary as long as the function that is required to be performed can be carried out. For example, in the phrase "generally rectangular in shape," the shape need not be exactly rectangular as long as the required function of the structure in question can be carried out.

In the following description, various embodiments of the present disclosure are described. In the following description and in the accompanying drawings, the corresponding systems assemblies, apparatus and units may be identified by the same part number, but perhaps with an alpha suffix. The descriptions of the parts/components of such systems assemblies, apparatus, and units that are the same or similar are not repeated so as to avoid redundancy in the present application.

Referring to the drawings and initially specifically to FIGS. 1-4, a kinetic breaching assist tool 10 includes a forward ram section 12 wherein a ram 14 slides within and forwardly out of a housing 16 for breaching doors or other barriers. The ram section 12 is connected to an intermediate propulsion section 18 that generates a high pressure gas to drive the ram 14 forwardly. The rear end of the propulsion section 18 is connected to a firing mechanism assembly 20 that is actuated by an elongated trigger 22 positioned within the confines of a manually graspable rear handle assembly 24. A forward handle assembly 26 is mounted at the forward portion of propulsion section 18 to enable the tool 10 to be conveniently and securely grasped with both hands.

Figure 4:
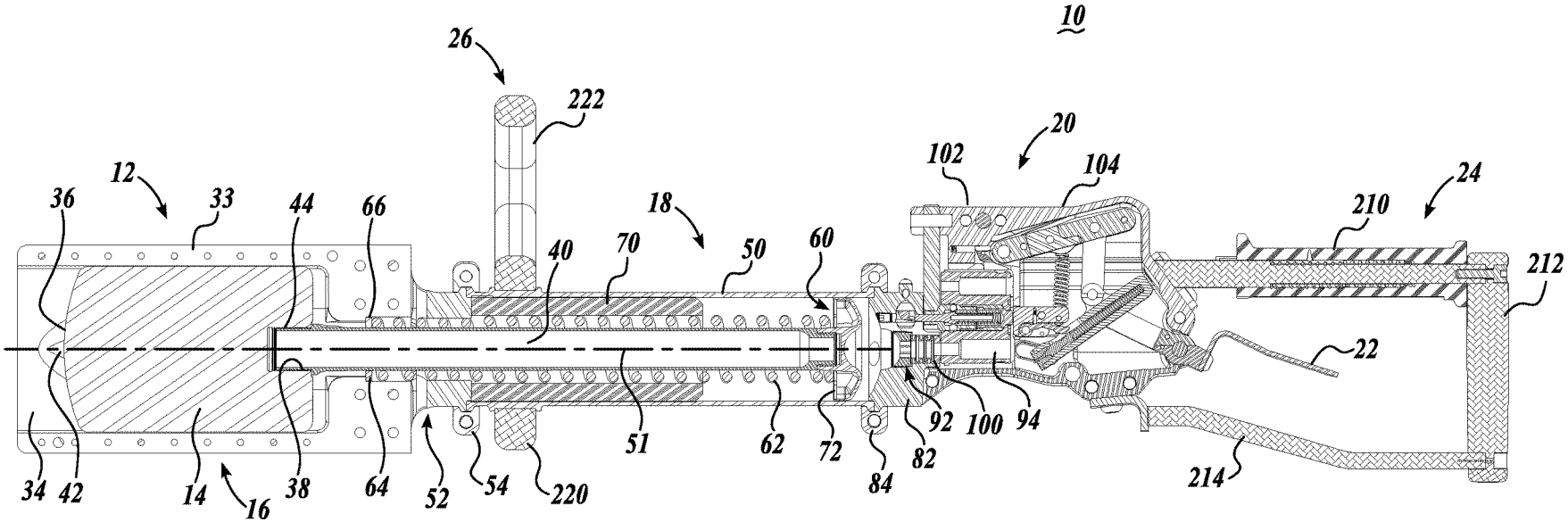
FIG. 4 is a side elevational view of the breaching assist tool taken in cross section along lines 4-4 of FIG. 2.

Next, describing the foregoing sections of the tool 10 in greater detail, ram 14 is guided for reciprocal motion within a clamshell-style housing 16 composed of formed side plate sections 32 for closely receiving the ram 14 therein. The side plate sections are generally rectilinear in shape, with inwardly directed flanges 33 that extend along the upper, rear and bottom side margins of the side plates. When assembled together, the side plates define a generally rectangular interior cavity 34 for closely receiving the generally rectangularly shaped ram 14 therein. As shown in FIG. 4, the ram has a curved forward end 36 that projects forwardly of the forward end of the housing 16 when the breaching assist tool 10 is actuated, as described below. The two side plate sections 32 of the housing 16 are fastened together by a series of hardware members, such as bolts, extending through the upper and lower flange sections, as well as the rearward flange section. These hardware members securely clamp the side plates 32 together.

The central longitudinal portion 35 of the side plates 32 are formed to bulge outwardly to define a cylindrical interior cavity section 38 to receive the forward end of a hollow cylindrical connecting rod 40 that is attached to the rearward end of the ram 14. The cylindrical cavity section 38, that bulges outwardly from the inside side faces of the side plates, defines an inner diameter that is wider than the width of the rest of the housing cavity 34. This construction is not only very rugged, but also serves a safety purpose. If the mechanisms provided for stopping the forward travel of the ram 14, as discussed below, do not operate properly allowing the ram 14 to continue forward beyond the normal travel distance of the ram, the forward end of the connecting rod 40 and associated section of the ram 14 will wedge against the tapered forward end 42 of the cavity 38, causing the connecting rod, together with the ram 14, to come to a stop. The forward end of the connecting rod 40 is connected to the rearward end of the ram 14, which is enlarged to define a socket 44 to be threadably or otherwise engaged with the forward end of the connecting rod 40.

The propulsion section 18 is constructed with a cylindrical outer cylinder or barrel 50 that houses most of the length of the connecting rod 40, see FIG. 4. The rear end of housing 16 is connected to the forward end of the outer cylinder/barrel 50 of the propulsion section 18 via an adapter 52 coupled to the forward end of the outer cylinder or barrel with a band coupling 54. Both the forward end of the outer cylinder 50 and the adjacent rear end of the adapter 52 are constructed with cylindrical flanges which are clamped together by the band coupling 54. Upper and lower side flanges 56 and 58 project forwardly from the adapter 52 to overlie the outer surfaces of the housing plates 32. Hardware members are used to extend through throughholes formed in the flanges 56 and 58, as well as aligned throughholes in the rear flange section of the housing side plates 32, thereby to create a secure connection between the adapter 52 and the ram housing 16.

Connecting rod 40 extends centrally within the longitudinal cylinder/barrel 50 along the longitudinal axis 51 of the cylinder/barrel to connect at its rearward end to a formed piston 60, sized to closely fit within the interior of cylinder/barrel 50. An elongate compression spring 62 encircles the connecting rod 40 and extends between the piston 60, and a shoulder 66 formed in the rear flange portion of the housing side plates 32 to somewhat control the forward travel of the piston, but primarily to return the piston to the retracted position, shown in FIG. 5B (FIG. 4 shows the piston in almost, but not fully, retracted position), after the firing of the tool 10 occurs. In this regard, the rear end of the compression spring 62 bears against the forward side of piston 60 with the forward end of the spring bearing against a washer 64 seated against the shoulder 66. As apparent, the spring 62 biases the piston 60 in the direction away from housing 16. It will be appreciated that spring 62 must be rugged enough to endure significant impact forces during the operation of the tool 10 due to the explosive propulsion of the piston 60 forwardly through the cylinder or barrel 50. In this regard, spring 62 can be of various designs, including for example of a variable pitch design, and can be composed of durable, impact-resistant material, so as to function satisfactorily for repeated cycles of the tool 10. A satisfactory duty cycle of the spring 62 will be at least 250 cycles without damage or significant loss of compression load. A duty cycle of a thousand cycles would be even better.

A cylindrically shaped compressible snubber 70 is positioned in the forward end portion of the interior of the barrel 50 and occupies a significant portion of the length of the barrel. The outer diameter of the snubber 70 closely engages against the inside diameter of the barrel 50, whereas the inside diameter of the cylindrical-shaped snubber is formed with significant clearance with respect to connecting rod 40 and compression spring 62. As described below, when the tool 10 is actuated, the forward face of the piston 60 presses against the rearward end of the snubber 70, thereby imposing a compression force on the snubber. The snubber is capable of absorbing the energy of the forwardly-moving piston and arresting the forward movement of the piston in a safe, controlled manner. In this regard, the snubber 70 can be composed of various materials, for example, urethane, which has a high energy absorption capability. The urethane can have a durometer of about 95A. It will be appreciated that by closely fitting the outer diameter of the snubber 70 within the barrel 50, the snubber is capable of absorbing significant compression load without buckling or significantly deforming. Other types of resilient material may be used in place of urethane, for example, neoprene. As shown most clearly in FIGS. 4 and 5, both the connecting rod 40 and the piston 60 are of hollow construction, to reduce their mass. The piston has a substantially flat forward face 72 for impacting against the end of the snubber 70 and bearing against the compression spring 62. The piston has a rearward body section that includes side wall section 74 that closely slides along the interior of the barrel 50. From the side wall section 74, the formed piston body curves to define a rear surface with the circumferential section 76 thereof formed in a convex shape. Next, the piston body section curves inwardly to define a central portion 78 that is of a concave shape, which functions to form the forward part of a generally spherical explosion or combustion chamber 80 of the tool 10. The explosion or combustion chamber is formed primarily within the interior of a generally cylindrical combustion chamber housing 82 projecting from the front of a housing 102 of the firing mechanism assembly 20. The rearward end of the propulsion section 18 is coupled to the explosion/combustion chamber housing 82 by a V-coupler 84 that clamps together a flange at the rear end of cylinder 50 with a similar flange at the forward end of the explosion/combustion chamber housing 82. Of course, the coupling of the propulsion section and the explosion/combustion chamber housing can be carried out in other ways.

Figure 5D:
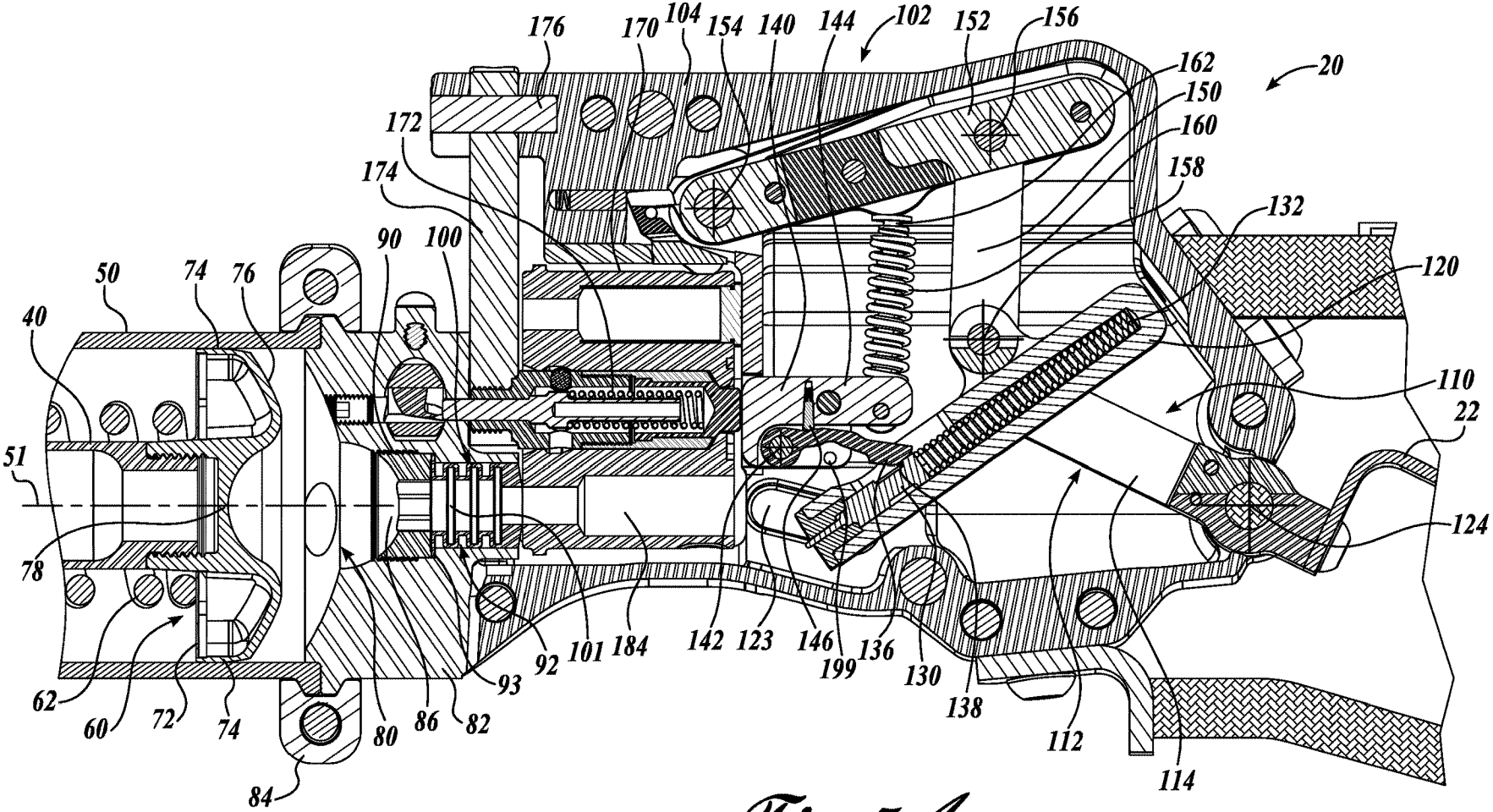
FIG. 5A is an enlarged fragmentary cross-sectional view of FIG. 4 with the firing pin in retracted position.
FIG. 5B is a view similar to FIG. 5A, but with the firing pin in a ready or firing position.
Figure 5B:
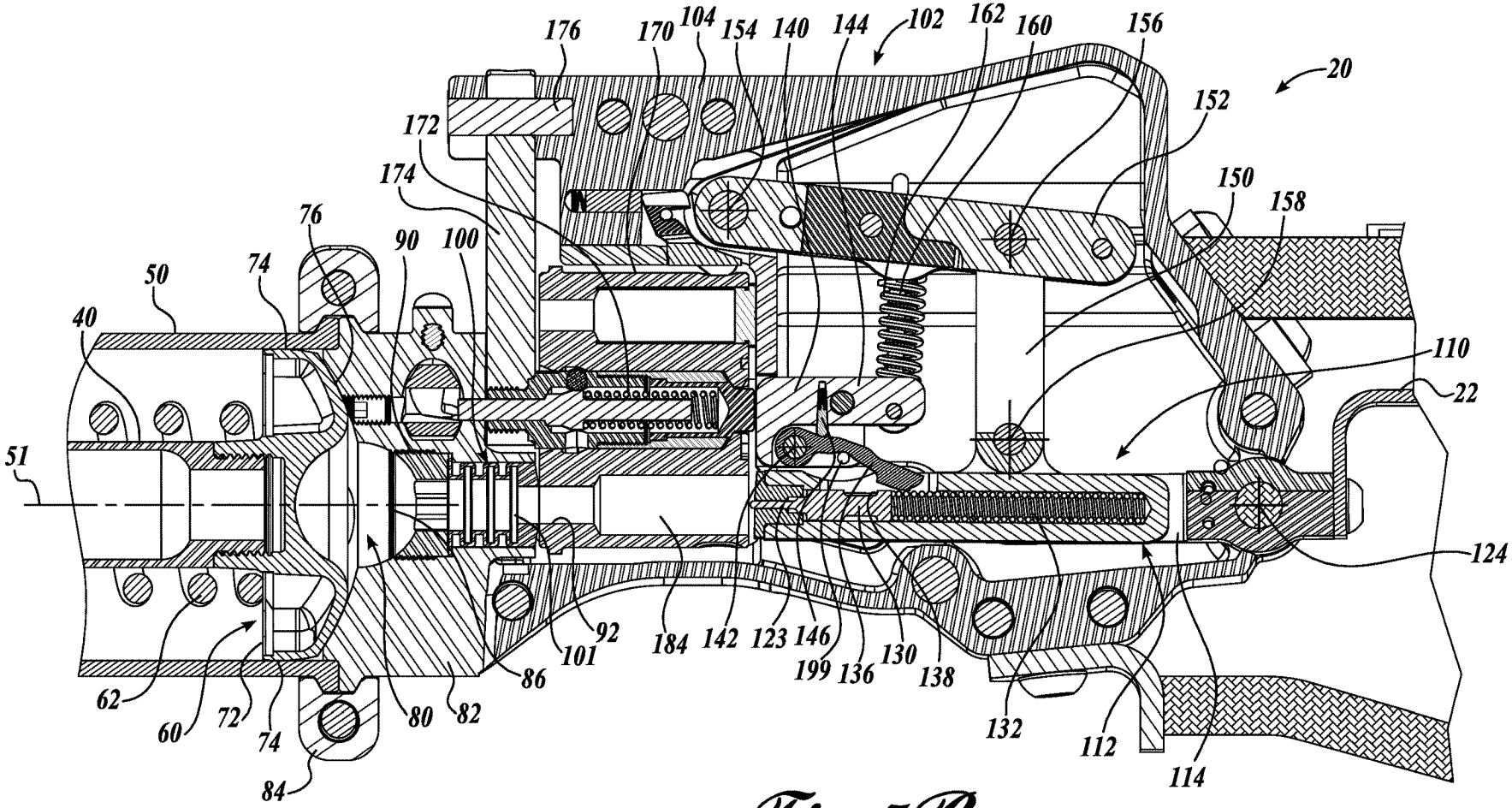

Referring specifically to FIGS. 4 and 5, the combustion chamber 80 is composed in part by the rearward side of piston 60, which as described above is centrally formed in a concave shape 78 to define part of the combustion chamber. The remaining rear section of the combustion chamber is formed in the housing 82 in a generally hemispherically shape 86.

As shown in FIGS. 4 and 5, sealing bellows 100 are positioned along the cylinder bore section 92 of the combustion chamber housing 82 at a location forward of the location of a magazine 170 (described below) and rearward of the seal retainer 90. The purpose of the bellows is to expand in length during the high pressure created by the firing of a cartridge 94 in the magazine 170, thereby to seal the combustion chamber 80 from the rearwardly located firing mechanism main housing 102 to minimize back leakage therethrough. In this regard, the rear of the bellows presses tightly against the front surface of the magazine 170 directly in front of the magazine bore 92 so that explosion gas does not leak out therebetween. The explosion gas fills the grooves 101 formed in the bellows, causing the bellows to expand. As will be appreciated, the bellows 100 provides a secure seal without the need to use a multicomponent seal, wherein the components are required to move relative to each other.

Once the piston 60 travels in a forward direction sufficiently so that the pressure within the combustion chamber reduces the bellows 100 relax to allow the venting of the gasses in the combustion chamber through the housing 102 during rebound of the ram. Once relaxed, the bellows 100 allows free motion of the piston 60 and connecting rod 40 to resume. The bellows 100 is constructed from heat-treated, stainless steel.

It will be appreciated that other types of valving mechanisms may be used in place of the bellows 100 to perform the same function as the bellows, for example, sliding or nested tubes. An important feature of the bellows is working in conjunction with cylinder which compresses forward against the bellows during the trigger pull. Sealing during ignition allows a more efficient use of propellant and consistent power output. Valving during rebound is a secondary feature, although using the back pressure during rebound is helpful.

A seal retainer 90 is disposed in a cylindrical bore section 92 of the combustion chamber housing 82 just rearwardly of the combustion chamber 80 to retain the bellows 100 in position. The bore section 92 is in concentric alignment with the axis 51 of the barrel 50. The forward side of the seal retainer is concave in shape to match the shape of the combustion chamber rear section 86. The seal retainer has external threads that engage with internal threads of the bore section 92 and seats against a shoulder 93 adjacent the front face of the bellows 100.

The firing mechanism assembly 20 includes the main housing 102 located rearwardly of the combustion chamber housing 82 for housing and supporting the firing mechanism of the tool 10. As shown most clearly in FIGS. 5A to 8, the firing mechanism includes an over-center firing mechanism 110 for firing the cartridge 94 disposed in magazine 170. The over-center firing mechanism 110 nominally positions a firing pin 130 out of alignment with the cartridge 94 to prevent the accidental firing of the cartridge (e.g., when the trigger 22 is not squeezed). As noted above, the other components of the firing mechanism assembly 20 are also housed within the firing mechanism main housing 102. The housing 102 is composed of two side panel structures 104 and 106 that are configured interiorly to house and support the components of the firing mechanism 110 as described below. Although not necessarily required, the combustion chamber housing 82 can be integrally formed with the firing mechanism housing side panel 106.

In the construction of the firing mechanism 110, the trigger 22 is attached to a lower pivot arm 112 assembly, composed of two spaced-apart arms 114 and 116 that are rotatably coupled to a firing pin housing 120. The trigger 22 is elongated so as to be squeezed by several fingers of the operator. The lower pivot arm assembly 112 includes transverse stub shafts 117 that extend transversely outwardly to engage with pivot bores formed in housing 102, thereby to enable the lower pivot arm 112 to pivot about axis 124 when trigger 22 is squeezed upwardly. Trigger 22 is secured to the rearward end of the lower pivot arm assembly 112 that projects rearwardly from the axis 124.

Figure 6:
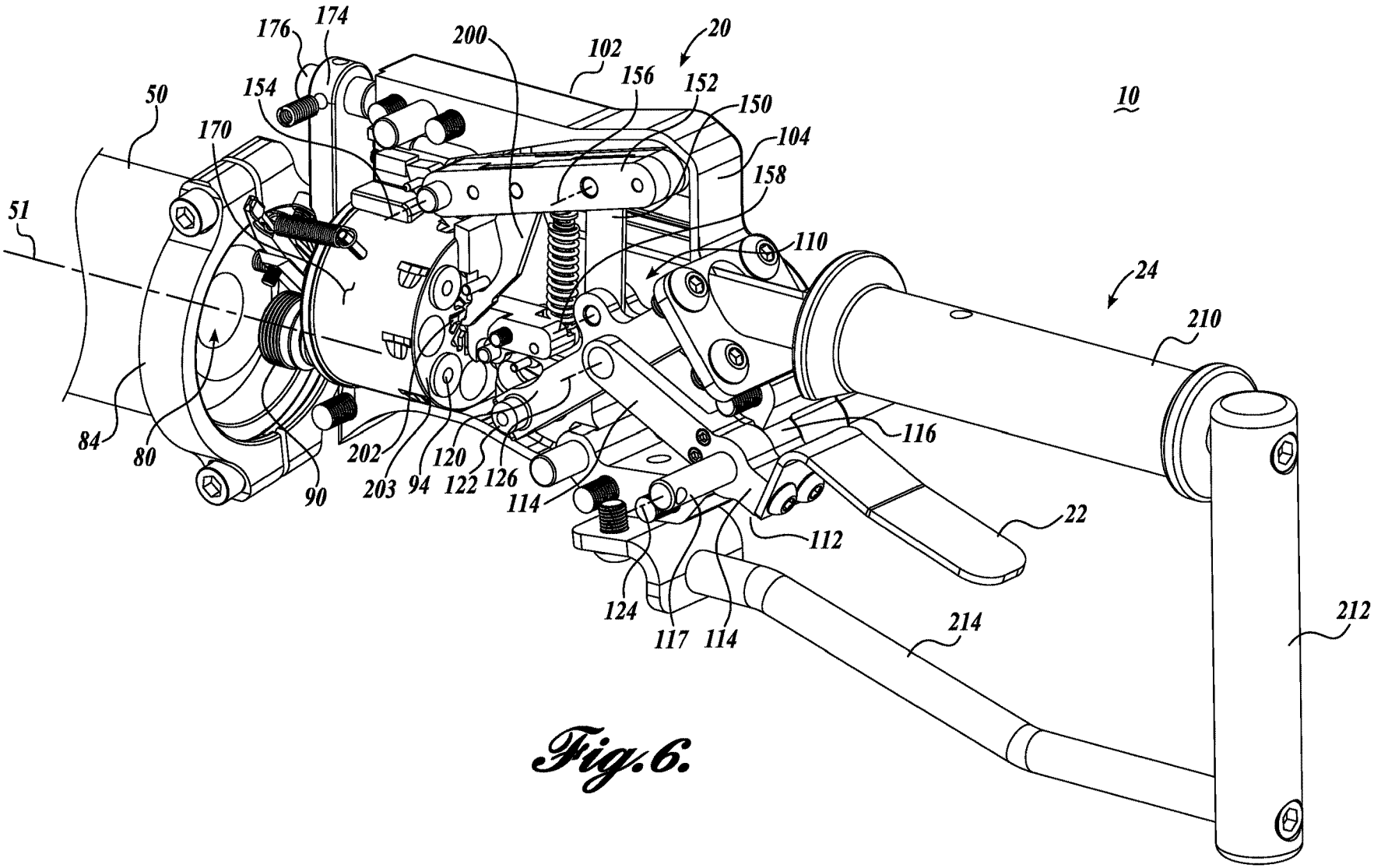
FIG. 6 is an enlarged fragmentary isometric view of the firing mechanism assembly of the tool.
Figure 7:
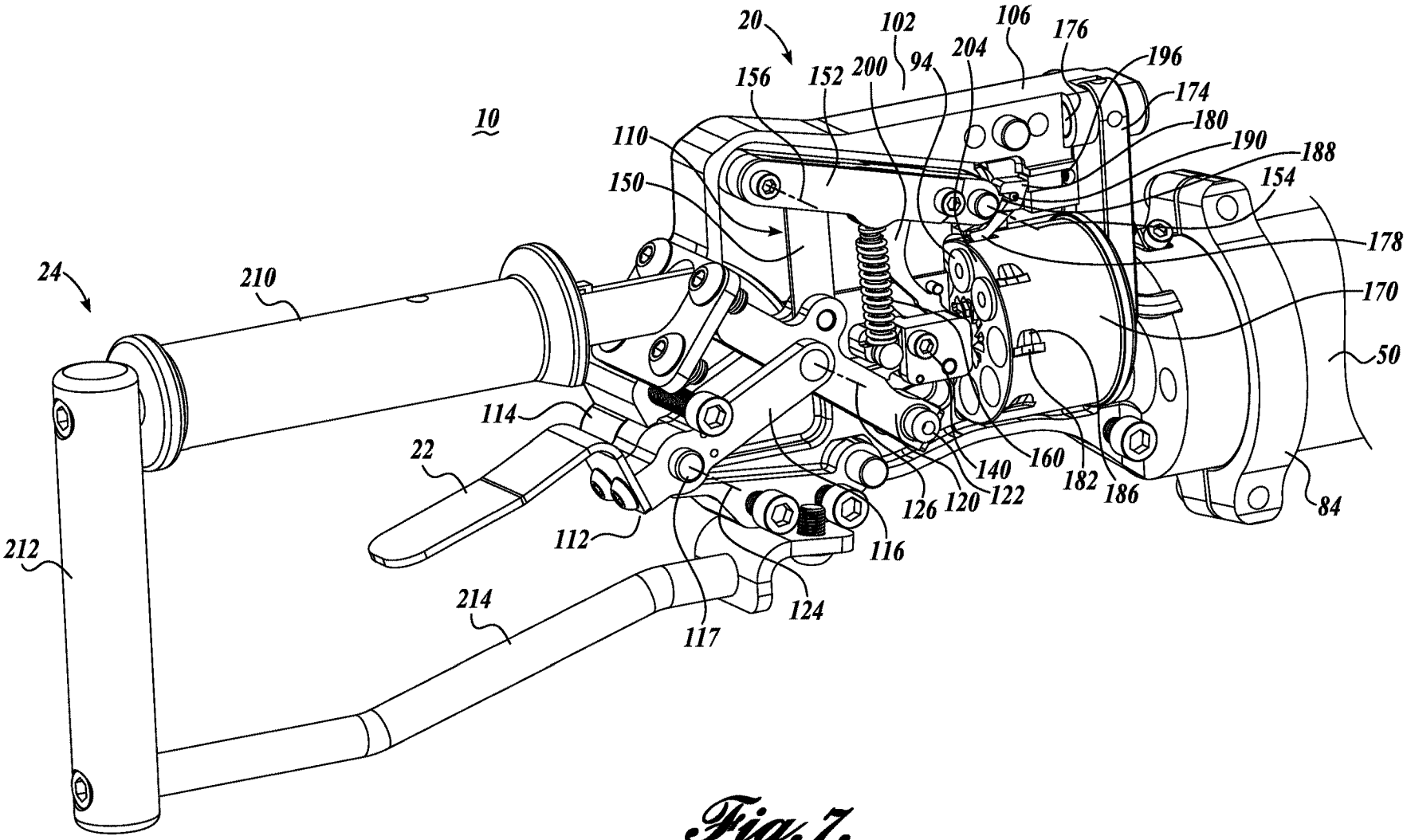
FIG. 7 is a view similar to FIG. 6, but taken from the opposite side of the tool.

As best shown in FIGS. 6 and 7, the spaced-apart arms 114 and 116 of the pivot arm assembly 112 straddle an elongate firing pin housing 120 and are pivotally attached thereto about rotational axis 126 located approximately midway along the length of the firing pin housing 120. Stub shafts 122 extend outwardly from opposite sides of the forward end of the firing pin housing to engage within slots 123 formed in the side panels 104 and 106 of the housing 102 to guide and position the forward end of the firing pin housing as the housing is shifted from this nominal retracted position shown in FIG. 5A to a ready and firing position shown in FIG. 5B.

The firing pin 130 is slidably positioned in the forward portion of the housing 120, with a firing pin spring 132 positioned between the rear end of the firing pin and the rearward closed end of the housing 120. See FIGS. 5A and 5B. As discussed below, the firing pin spring 132 applies a forward force against the rear of the firing pin 130, thereby propelling the firing pin forwardly against the cartridge 94 when the firing mechanism is actuated, as described below.

A firing pin catch 136 nominally bears against the forward surface of a rear shoulder 138 formed in the rear portion of the firing pin 130. The firing pin catch 136 is pivotally mounted at its forward end to a carrying block 140 to pivot about a pivot axis 142. The carrying block 140 is securely mounted stationary in the main housing 102 and is formed with a cantilevered, rearwardly extending ledge portion 144, the underside of which bears against the upper surface of the firing pin catch 136 to serve as a stop for the catch. A resistance spring 145 is located in a vertical blind bore formed in the block 140 to press against a pusher pin 146, which in turn presses against the top side by the firing pin catch 136 to keep the catch engaged against the firing pin. The rearward leading end of the firing pin catch 136 is configured to bear against the firing pin shoulder 138 when the firing pin and its housing 120 are in the nominal position shown in FIGS. 5A, 6 and 7.

As also shown in FIGS. 5-7, an upper link 150 is pivotally interconnected between a central portion of the firing pin housing 120 and a distal forward rear portion of an upper pivot arm 152. The upper link 150 is pinned to the upper pivot arm 152 at pivot axis 156 and is pivoted to the firing pin housing 120 at pivot axis 158. The upper forward end of the pivot arm 152 is rotatably pinned to the housing 102 at pivot axis 154.

A return spring 160 bears against the underside of the upper pivot arm 152 to bias the upper pivot arm in an upward direction, as shown in FIGS. 5-7. This in turn biases the firing pin housing 120 into the upwardly retracted position also shown in FIG. 5A. The return spring 160 is engaged over an elongated core 162 to prevent the return spring from buckling.

The firing mechanism assembly 20 includes a revolvable magazine 170 having a plurality of chambers 184 for receiving blank cartridges 94. The magazine is mounted on a central axis assembly 172 that cantilevers rearwardly from the lower, depending end of a swing arm 174. The upper end of the swing arm 174 is pivotally attached to a pivot pin 176 that is mounted horizontally to the upper forward corner of housing side panel 104, see FIGS. 5-8. By this arrangement, the cartridge magazine can be conveniently swung out of the housing 102 to either load and/or unload the cartridges 94 from the magazine 170 or replace the magazine with, for example, another one that is filled with cartridges, which may be faster than removing the individual spent cartridges 94 and replacing them with new cartridges.

Figure 8:
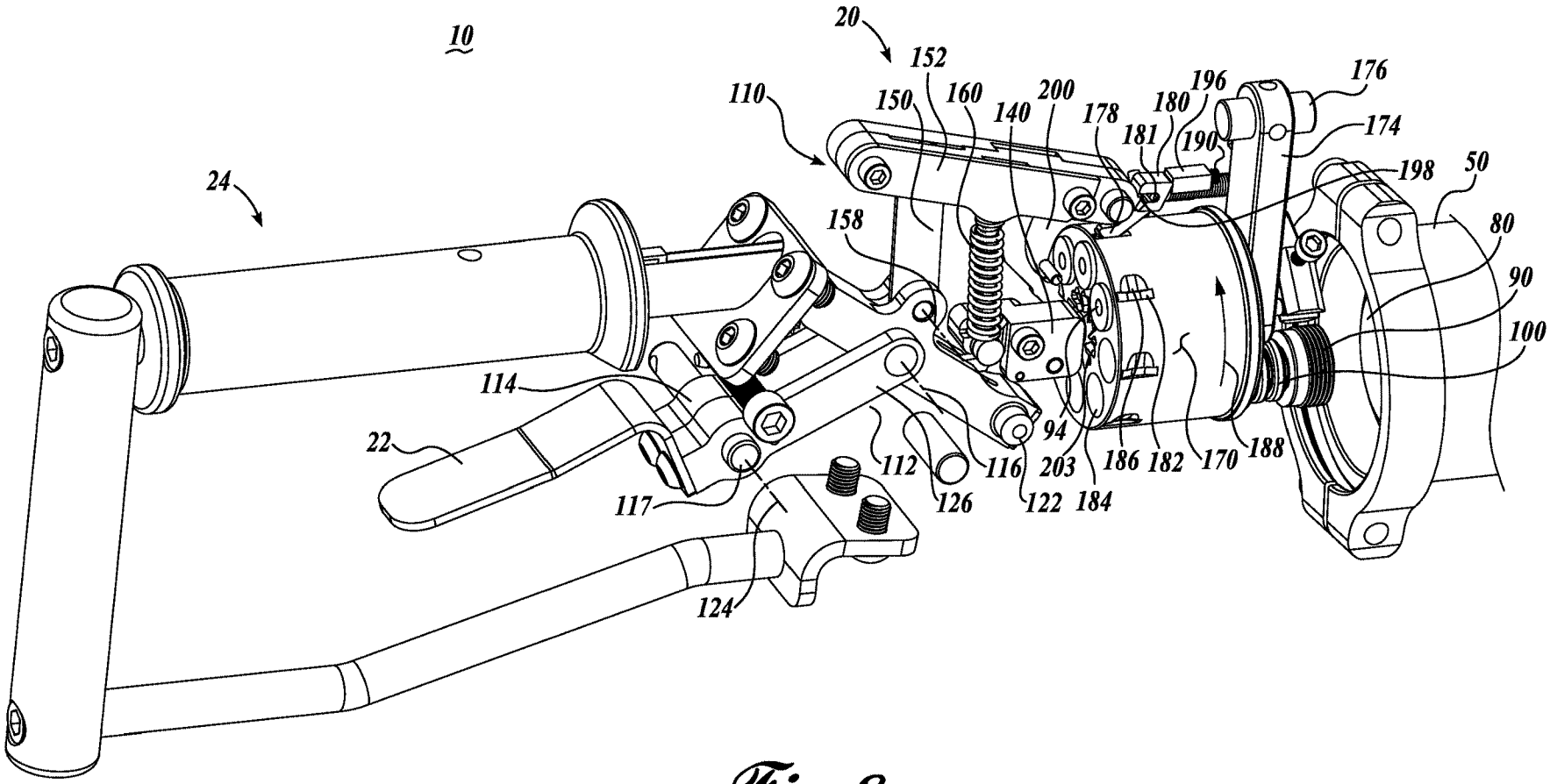
FIG. 8 is a view similar to FIG. 7, but with additional components not shown to provide a better view of the operation of the magazine.

Cartridge magazine 170 is held against rotation on the pivot axis assembly 172 (see FIGS. 5A and 5B) by a pawl 178 extending downwardly from a pivot block 180 pivotally mounted to an upper portion of the housing side panel 106 centrally above the cartridge magazine, see FIG. 8. A stub shaft 181 extends laterally from the pivot block to engage within a blind hole (not shown) in the inside of side panel 106. The downwardly extending end of the pawl 178 is designed to engage within detents 182 associated with each of the chambers 184 of the cartridge magazine. As shown in FIG. 8, the detents 182 are formed in the outer circumference of the cartridge magazine in alignment with a cylinder chamber 184. A lead-in 186 is cut into the exterior of the magazine to create a transition between the detent 182 and the outer circumference of the cartridge magazine thereby facilitating the engagement of the pawl with the detent when the cartridge magazine 170 is rotated in the direction of arrow 188 when the magazine is advanced during the operation of the firing mechanism, as described below.

A spring 190 is captive within a slot or blind hole (not shown) formed in a block 196 which is secured to an overhead portion of the housing side panel 106. The spring 190 presses against the adjacent end of the pivot block 180 thereby to lock the distal end of the pawl in the detent 182. However, when the firing mechanism 110 is actuated, as described below, the upper pivot arm 152 pivots about axis 154 which causes a tang 198 at the distal end of the pivot arm 152 to engage the pivot block 180 and the block to pivot about stub shaft 181 thereby to raise the distal end of the pawl 178 out of the detent 182, thereby permitting the cartridge magazine 170 to rotate about the pivot pin assembly 172.

To activate the firing mechanism, the trigger 22 is squeezed, causing the lower pivot arm 112 to rotate counterclockwise about axis 124. This causes the firing pin housing 120 to both rotate in the clockwise direction about the axis of lower stub shafts 122 and move forwardly in slot 123 to align the firing pin 130 with the magazine chamber 184. See FIG. 5B. During this rotational and longitudinal movement of the firing pin housing 120, the firing pin is also moved forwardly to the rear of the magazine chamber 184. As a consequence, the catch 136, bearing against the firing pin 130, causes the firing pin spring 132 to compress. As the firing pin housing 120 moves closer into alignment with the chamber 184, the downward pivot of the firing pin catch 136 is stopped by a stub pin 199 that bears against the underside of the catch so that the catch no longer bears against the firing pin. As a consequence, the firing pin is released and propelled forwardly under the force of the firing pin spring 132, thereby exploding the cartridge 94 which has been placed in alignment with cylinder bore 92 of the combustion chamber 80.

The magazine 170 is rotated as the trigger 22 is being squeezed to place a chamber 184 in registry with the firing pin 130. In this regard, as most clearly shown in FIGS. 6 and 7, a finger 200 depends downwardly from the upper pivot arm 152 to engage and press against a detent 202 provided in the rear face 203 of the magazine 170 at a location to the side of the pivot axis of the magazine, thereby to rotate the magazine so that the next chamber 184 is placed in registry with the axis 51 of the barrel and combustion chamber.

When the cartridge 94 has been fired, the explosion generated thereby forces the piston 60 forwardly, which in turn drives the connection rod 40 and ram 14 forwardly so that the ram forward end 36 protrudes from the forward end of the ram housing 16, and thereby functions to breach the door or other barrier. When the piston 60 propels forwardly sufficiently in the cylinder 50, the piston 60 bears against the rearward portion of the compressible snubber 70 positioned in the forward portion of cylinder 50.

Once the ram 14 has traveled to its furthest-most extended position, the ram, piston rod, and piston assembly rebound due to both the expansion of the compressed snubber 120 and the action of the compressed return spring 62, thereby returning the piston and piston rod toward their starting position. The residual gas from the firing operation is compressed and helps to decelerate the piston, connecting rod, and ram assembly in their backward return travel to reduce the impact force applied against the combustion chamber 80.

Figure 2:
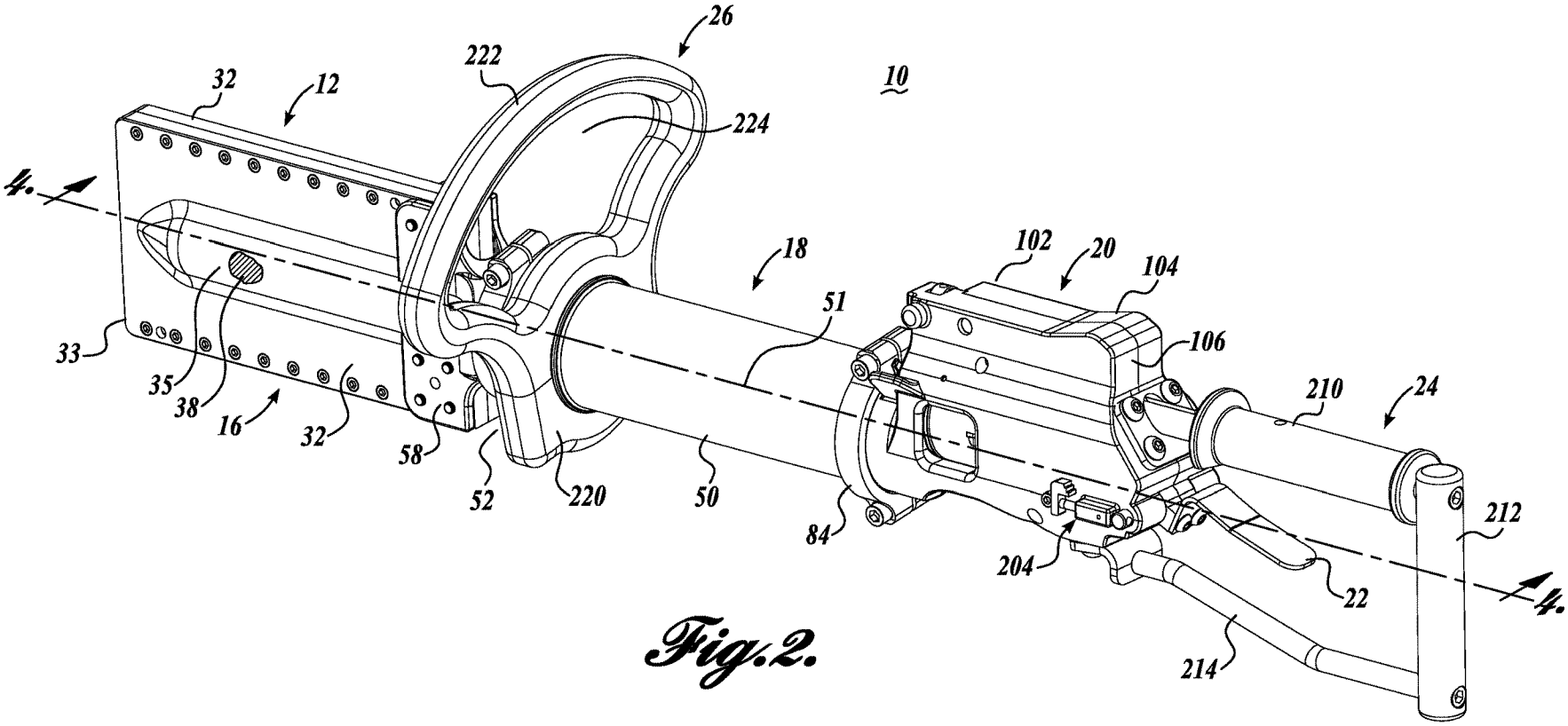
FIG. 2 is an isometric view of the breaching assist tool similar to FIG. 1, but taken from the backside of the tool.
Figure 3:
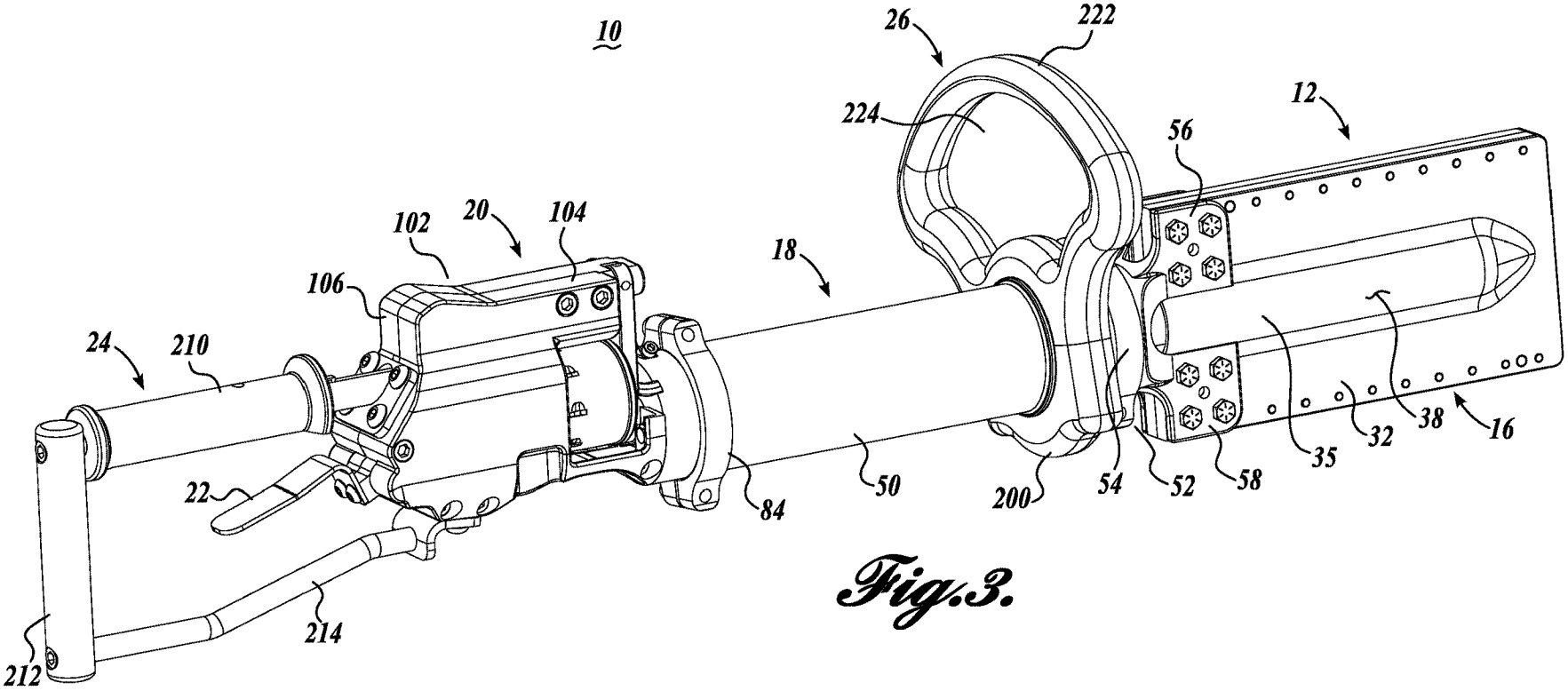
FIG. 3 is a view similar to FIG. 2, but taken from the opposite side of the tool.
Figure 9:
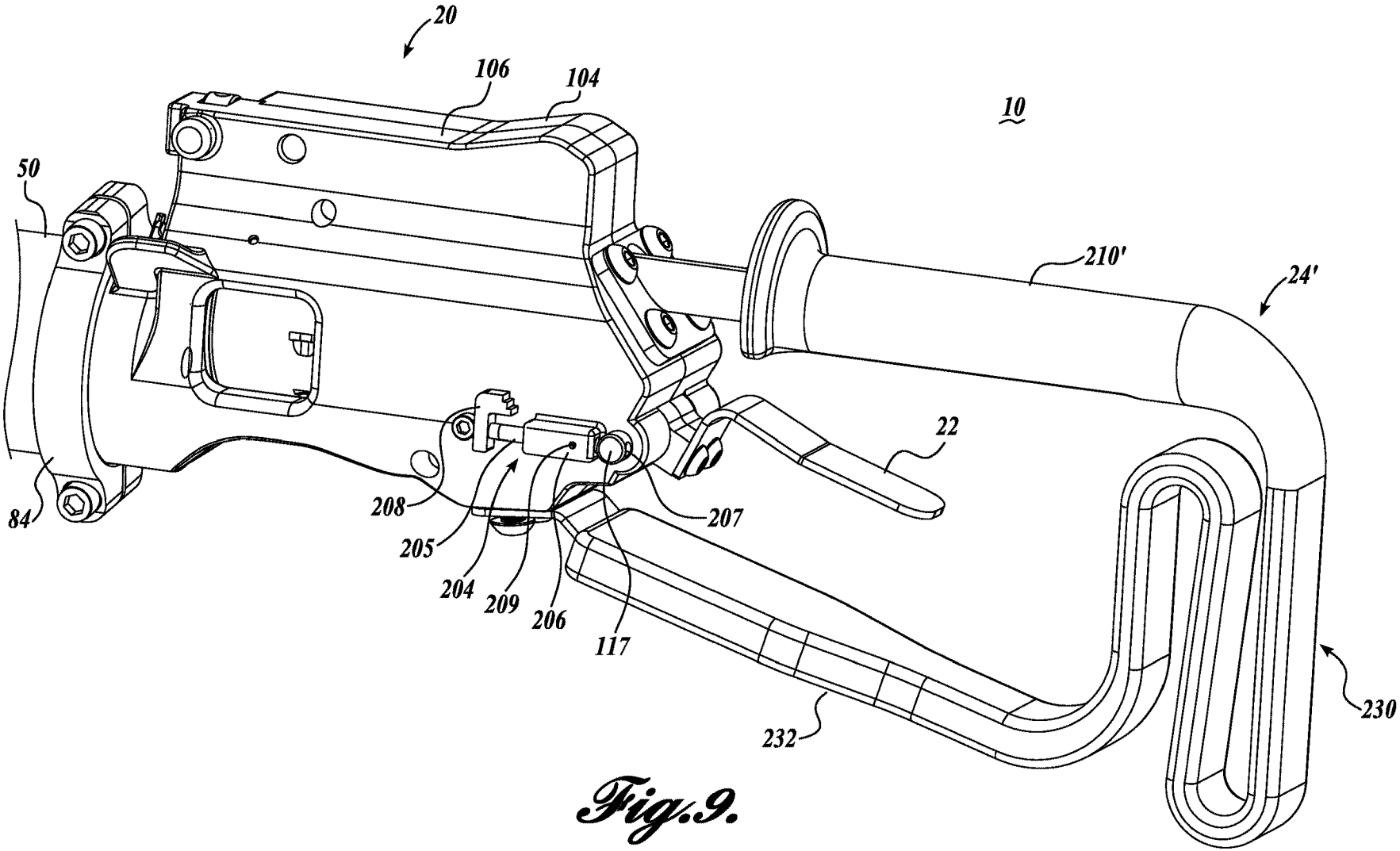
FIG. 9 is an enlarged fragmentary isometric view of an embodiment of the present disclosure.

Referring primarily to FIGS. 2, 6 and 9, a safety mechanism 204 is provided for the inadvertent actuation of trigger 22. In this regard, slide pin 205 is slidably engaged within a slide housing 206 mounted to the outside of the side panel 206. The rear end portion of the pin 205 is engageable within a crosshole 207 formed in stub shaft 117. As explained above, when trigger 22 is squeezed, the stub shaft 117 rotates about axis 124 to enable the lower pivot arm 114 to also pivot about the axis 124. However, when the slide pin 205 is engaged within the crosshole 207, the stub shaft is prevented from rotating about the axis 124.

A spring loaded detent ball (not shown) is mounted in a crosshole formed in the slide pin 205. When the slide pin 205 is held in the engaged position (to prevent rotation of stub shaft 117), the detent ball and the corresponding section of the slide pin 205 extend through and beyond the crosshole 207 to securely keep the slide pin engaged within the crosshole. When the slide pin is in retracted position, the detent ball engages into a crosshole 209 formed in the slide housing, which retains the slide pin in place. The slide pin is manually advanced and retracted by manipulating a handle 209 attached to the distal end of the slide pin 205.

Referring to FIGS. 1-4 and 6-8, the rear handle 24 is designed to conveniently grip the rear of the tool 10 and also to absorb shock generated by the tool when it is fired. To this end, the rear handle 24 includes an upper horizontal cylindrical section 210 that is sized to be conveniently gripped by the user. A vertical rearward cylindrical section 212 extends downwardly from the rear end of horizontal section 210 to the rearward end of a lower generally S-shaped horizontal section 214. The vertical section 212 is also sized and configured to be conveniently and securely gripped by the user. The horizontal section is designed to flex and absorb the shock due to the recoil of the tool 10 when fired. The handle 210 can be constructed of various materials, for example, metal covered by a shock-absorbing plastic material such as a urethane.

As shown in FIGS. 1-4, the front handle 26 includes a collar section 220 that encircles the forward end of the barrel 50. The forward handle 26 also has an arcuate grasping portion 222 providing an opening 224 for the user's fingers. The forward handle 26 can be constructed of various materials, such as metal coated with a shock-absorbing, but durable material, such as polyurethane.

Referring to FIG. 9, an alternative rear handle 24' is illustrated as constituting a top horizontal section 210' similar to horizontal section 210 of handle 24. However, in place of vertical section 212 of handle 24, the handle 24' has a serpentine vertical section 230 leading to a lower generally horizontal bottom section 232. The serpentine vertical section 230 is designed to flex during the recoil of the tool 10 so as to absorb at least some of the recoil shock. The handle 24' can be constructed from an interior metal frame covered with a shock-absorbing material to provide a securely graspable exterior. Of course, other configures for the handles 24, 24', and 26 can be utilized. In this regard, it is desirable that the handles be lightweight, but very strong and durable while still absorbing at least some of the recoil shock generated by the tool 10.

It will be appreciated that the tool 10 described above provides significant features and advantages over prior breaching tools, including:

The tool of the present disclosure generates high pressure gas which is used to accelerate a piston, connecting rod and ram assembly (PRA) to high speeds over a short distance. The combined mass and speed of the PRA results in up to 1200 foot pounds of kinetic energy at the face of the ram which is used for breaching and penetration of barriers to entry.

The size and weight of the tool is designed to minimize the recoil effects on the operator while creating maximum breaching energy at the point where the tool is in contact with an obstacle.

The ergonomics have been designed to allow the operator to safely hold the tool with both hands and direct the high energy output to any desired location.

For overall safety and reliability, the tool is constructed from high strength metal alloys and reliable mechanical designs to produce a tool that is uniquely powerful and safe. The tool can be used repeatedly, having eight cartridges in a quick change cylinder which can be replaced very quickly (in seconds).

While the preferred embodiment of the invention has been illustrated and described, it will be appreciated that various changes can be made therein without departing from the spirit and scope of the invention.

The invention claimed is:

1. A breaching assist tool, comprising:

i. a ram disposed within a ram housing, the ram housing having an opening through which the ram is propelled during actuation of the tool;

ii. a propulsion section connected to the ram housing, the propulsion section comprising an elongated barrel with a cylindrical interior within which is disposed a piston slidable within the interior of the barrel and a connecting rod connecting the piston to the ram, the propulsion section also comprising an explosion chamber opposite the ram housing and in communication with the piston, having a forward side facing the ram housing and a back side opposite to the ram housing;

iii. a firing mechanism assembly in communication with the explosion chamber to fire an explosive cartridge, with the gases generated by the explosion of the cartridge entering the explosion chamber and in turn propelling the piston, connecting rod, and ram forwardly, to propel the ram out of the ram housing, wherein the piston, the connecting rod, and the ram comprise an assembly that travel as a unit;

iv. a braking system for braking the forward travel of the piston, connecting rod, and ram assembly, the braking system comprising:

an elongated snubber disposed within the propulsion section barrel to bear against the piston when the piston has traveled a portion of a length of the barrel forwardly within the barrel toward the ram housing during actuation of the breaching assist tool; and a return actuator acting against the forward side of the piston to urge the assembly of the piston, the connecting rod, and the ram to a nominal rearward return position within the barrel once the breaching assist tool has been actuated and the ram propelled out of the ram housing, wherein:

the ram housing has a first interior width closely corresponding to a width of the ram; and the connecting rod is disposed within the interior of the ram housing and having a width larger than the first interior width of the ram housing, the ram housing having a localized width larger than the first width of the ram housing to accommodate the width of the connecting rod.

2. The breaching assist tool according to claim 1, wherein the connecting rod has a diameter that is larger than the first interior width of the ram housing.

3. The breaching assist tool according to claim 2, wherein a portion of the ram at the connection of the ram to the connecting rod is enlarged in width, wherein the enlarged width is larger than the width of the ram.

4. The breaching assist tool according to claim 3, wherein a portion of the interior of the ram housing adjacent the propulsion section has an enlarged width to accommodate the enlarged width of the ram and connecting rod, with the portion of the ram housing opposite the propulsion section of a width to accommodate the width of the ram but not the width of the enlarged section of the ram.

5. The breaching assist tool according to claim 1, wherein the elongated snubber of the braking system is cylindrical in shape, having an outside diameter closely corresponding to the inside diameter of the barrel.

6. The breaching assist tool according to claim 5, wherein the snubber comprises a viscoelastic material capable of absorbing the energy of the forwardly propelled piston during actuation of the breaching assist tool.

7. The breaching assist tool according to claim 1, wherein the return actuator comprises a spring extending between the piston and a location in either the propulsion section or the ram housing.

8. The breaching assist tool according to claim 7, wherein the compression spring is bearing against a portion of the interior of the ram housing.

9. The breaching assist tool according to claim 1, wherein the firing mechanism assembly comprises a housing having a forward portion mating with the rearward portion of the propulsion section and a cartridge chamber positioned in the firing mechanism assembly housing in communication with the explosion chamber.

10. The breaching assist tool according to claim 9, wherein the propulsion section comprises a passageway between the explosion chamber and the cartridge chamber.

11. The breaching assist tool according to claim 10, further comprising a sealing mechanism to seal the explosion chamber passageway against the cartridge chamber when a cartridge is fired in the cartridge chamber.

12. The breaching assist tool according to claim 11, wherein the sealing member comprises a bellows assembly that expands in length upon the explosion of a cartridge in the cartridge chamber, thereby to seal the explosion chamber passageway against the cartridge chamber.

13. The breaching assist tool according to claim 1, wherein the firing mechanism assembly comprises a firing pin for actuating a cartridge disposed in a chamber of a cartridge magazine, the firing pin nominally out of alignment with the cartridge chamber.

14. The breaching assist tool according to claim 13, wherein the firing mechanism assembly comprises a linkage system for supporting the firing pin and positioning the firing pin into alignment with the cartridge chamber to fire a cartridge disposed within the cartridge chamber.

15. The breaching assist tool according to claim 14, wherein the firing pin is disposed within a firing pin housing, the firing pin housing mounted to the linkage system; and further comprising a firing pin spring disposed within the firing pin housing to propel the firing pin toward the cartridge disposed in the cartridge chamber.

16. The breaching assist tool according to claim 13, wherein the firing mechanism assembly comprises a cylindrically shaped cartridge magazine configured to revolve about a central axis, thereby to align cartridge chambers within the cartridge magazine with the explosion chamber when firing a cartridge disposed within a cartridge chamber of the magazine.

17. A breaching assist tool, comprising:

i. a ram disposed within a ram housing, the ram housing having an opening through which the ram is propelled during actuation of the tool;

ii. a propulsion section connected to the ram housing, the propulsion section comprising an elongated barrel with a cylindrical interior within which is disposed a piston slidable within the interior of the barrel and a connecting rod connecting the piston to the ram, the propulsion section also comprising an explosion chamber opposite the ram housing and in communication with the piston, having a forward side facing the ram housing and a back side opposite to the ram housing;

iii. a firing mechanism assembly in communication with the explosion chamber to fire an explosive cartridge, with the gases generated by the explosion of the cartridge entering the explosion chamber and in turn propelling the piston, connecting rod, and ram forwardly, to propel the ram out of the ram housing, wherein the piston, the connecting rod, and the ram comprise an assembly that travel as a unit;

iv. a braking system for braking the forward travel of the piston, connecting rod, and ram assembly, the braking system comprising:

an elongated snubber disposed within the propulsion section barrel to bear against the piston when the piston has traveled a portion of a length of the barrel forwardly within the barrel toward the ram housing during actuation of the breaching assist tool; and a return actuator acting against the forward side of the piston to urge the assembly of the piston, the connecting rod, and the ram to a nominal rearward return position within the barrel once the breaching assist tool has been actuated and the ram propelled out of the ram housing;

wherein the piston is of hollow construction, comprising a forward face toward the ram housing and a rearward face having a central, concave section defining a portion of the explosion chamber; and wherein the explosion chamber comprises a housing portion coupled to the rearward end of the barrel, the explosion chamber defined by an explosion chamber housing configured with a concave portion in longitudinal alignment with the concave section of the rearward face of the piston.

18. The breaching assist tool according to claim 17, wherein the concave section comprises a spherical forward part of the explosion chamber.

19. A breaching assist tool, comprising:

i. a ram disposed within a ram housing, the ram housing having an opening through which the ram is propelled during actuation of the tool;

ii. a propulsion section connected to the ram housing, the propulsion section comprising an elongated barrel with a cylindrical interior within which is disposed a piston slidable within the interior of the barrel and a connecting rod connecting the piston to the ram, the propulsion section also comprising an explosion chamber opposite the ram housing and in communication with the piston, having a forward side facing the ram housing and a back side opposite to the ram housing;

iii. a firing mechanism assembly in communication with the explosion chamber to fire an explosive cartridge, with the gases generated by the explosion of the cartridge entering the explosion chamber and in turn propelling the piston, connecting rod, and ram forwardly, to propel the ram out of the ram housing, wherein the piston, the connecting rod, and the ram comprise an assembly that travel as a unit;

iv. a braking system for braking the forward travel of the piston, connecting rod, and ram assembly, the braking system comprising:

an elongated snubber disposed within the propulsion section barrel to bear against the piston when the piston has traveled a portion of a length of the barrel forwardly within the barrel toward the ram housing during actuation of the breaching assist tool; and a return actuator acting against the forward side of the piston to urge the assembly of the piston, the connecting rod, and the ram to a nominal rearward return position within the barrel once the breaching assist tool has been actuated and the ram propelled out of the ram housing; and a front handle and a rear handle, wherein the front handle is comprised of a shock-absorbing material, and the rear handle is comprised of a flexible section.

* * * * *